US006544912B1

(12) United States Patent
Tanio et al.

(10) Patent No.: US 6,544,912 B1
(45) **Date of Patent: *Apr. 8, 2003**

(54) WATER-DECOMPOSABLE FIBROUS SHEET CONTAINING FIBRILLATED RAYON OF DIFFERENT FIBER LENGTH PROFILES

(75) Inventors: Toshiyuki Tanio, Kagawa (JP); Jyoji Shimizu, Kagawa (JP); Kazuya Okada, Kagawa (JP); Naohito Takeuchi, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 294 days.

This patent is subject to a terminal disclaimer.

(21) Appl. No.: 09/627,015

(22) Filed: Jul. 27, 2000

(30) Foreign Application Priority Data

Mar. 31, 2000 (JP) ..... 2000-099487

(51) Int. Cl.[7] ..... D21H 27/36

(52) U.S. Cl. ..... 442/408; 162/115; 162/141; 162/146; 162/149; 162/157.6; 162/157.7; 428/311.31

(58) Field of Search ..... 442/408; 162/115, 162/141, 146, 149, 157.7, 157.6; 428/311.31

(56) References Cited

U.S. PATENT DOCUMENTS 3,785,918 A * 1/1974 Kawai ..... 426/372
4,755,421 A * 7/1988 Manning et al. ..... 442/338
6,042,769 A 3/2000 Gannon et al. ..... 264/203
6,258,210 B1 * 7/2001 Takeuchi et al. ..... 162/115

FOREIGN PATENT DOCUMENTS

| | | | |
|---|---|---|---|
| EP | 0303528 A1 | | 2/1989 |
| EP | 0945536 A2 | | 9/1999 |
| FR | 1423789 | | 3/1966 |
| GB | 687041 | | 2/1953 |
| JP | 107-0062 | * | 3/1989 |
| JP | 3-292924 | | 12/1991 |
| JP | 6-198778 | | 7/1994 |
| JP | 7-24636 | | 3/1995 |

* cited by examiner

*Primary Examiner*—Terrel Morris
*Assistant Examiner*—John J. Guarriello
(74) *Attorney, Agent, or Firm*—Darby & Darby

(57) ABSTRACT

Provided is a water-decomposable fibrous sheet includes fibers containing fibrillated rayon. The fibrillated rayon has primary fibers of a predetermined fiber length and microfibers extending from the primary fibers. The fibrillated rayon includes a first type of fibrillated rayon having a degree of beating of at most 700 cc, of which the length of the primary fibers falls between 1.8 mm and 4.0 mm at the peak of its self-weighted, average fiber length distribution profile curve, and a second type of fibrillated rayon having a degree of beating of at most 700 cc, of which the length of the primary fibers falls between 4.5 mm and 10.0 mm at the peak of its self-weighted, average fiber length distribution profile curve. The microfibers extending from the first and second, types of fibrillated rayon are entangled with and/or hydrogen-bonded to at least either of other microfibers and other fibers.

12 Claims, 4 Drawing Sheets

WATER-DECOMPOSABLE FIBROUS SHEET CONTAINING FIBRILLATED RAYON OF DIFFERENT FIBER LENGTH PROFILES

BACKGROUND OF THE INVENTION

1. Field of the Invention

The present invention relates to a water-decomposable fibrous sheet capable of being readily decomposed and dispersed in water flow. More precisely, it relates to such a water-decomposable fibrous sheet having good decomposability in water and high strength in wet.

2. Description of the Related Art

To wipe the skin of human bodies including the private parts thereof, or to clean toilets and thereabouts, used are disposable cleaning sheets made of paper or non-woven fabric. For these cleaning sheets, water-decomposable cleaning sheets that could be directly disposed of in toilets after use have been developed, as being convenient for such purposes. The degree of their decomposability in water must be high in some degree. This is because, if poorly water-decomposable cleaning sheets are disposed of in toilets after use, they will take a lot of time until they are decomposed and dispersed in septic tanks, or will clog the drainpipes around toilets, etc.

For wiping off wet dirt and for easy and effective use, many cleaning sheets for wiper applications are packaged while being wetted with a liquid detergent chemical or the like, and are put on the market. Therefore, such water-decomposable cleaning sheets must have high strength in wet to such a degree that they are well fit for wiping with them wetted with such a liquid chemical or the like, but must well decompose in water after they are disposed of in toilets.

For example, Japanese Patent Publication No.24636/1995 discloses a water-decomposable cleaning article that comprises a water-soluble binder having a carboxyl group, a metal ion and an organic solvent. However, the metal ion and the organic solvent irritate the skin.

Japanese Patent Laid-Open No. 292924/1991 discloses a water-decomposable cleaning article of polyvinyl alcohol-containing fibers with an aqueous solution of boric acid infiltrated thereinto; and Japanese Patent Laid-Open No. 198778/1994 discloses a water-decomposable napkin of polyvinyl alcohol-containing non-woven fabric with a borate ion and a bicarbonate ion introduced thereinto. However, polyvinyl alcohol is not resistant to heat, and therefore the wet strength of the water-decomposable cleaning article and the water-decomposable napkin is lowered at 40° C. or higher.

Recently, various water-decomposable absorbent articles including sanitary napkins, panty liners, disposable diapers and others have been investigated in the art. In view of their safety, however, the water-decomposable fibrous sheets mentioned above could not be used as the top sheets for those absorbent articles that-shall be kept in direct contact with the skin for a long period of time, as they contain a binder and an electrolyte.

On the other hand, Japanese Patent Laid-Open No. 228214/1997 discloses a water-degradable non-woven fabric having a wet strength of from 100 to 800 gf/25 mm (from 0.98 to 7.84 N/25 mm) as measured according to JIS P-8135, which is produced by mixing fibers having a length of from 4 to 20 mm with pulp followed by entangling them through treatment with high-pressure water jets. Since the constituent fibers are entangled in it, the non-woven fabric disclosed has a bulky feel. However, in producing the non-woven fabric, long fibers are entangled through high-pressure water jet treatment, whereby the non-woven fabric produced could have such a relatively high wet strength. Therefore, according to the technique disclosed, it is difficult to realize well-balanced bulkiness, strength and water-degradability for the non-woven fabric produced, and the non-woven fabric produced is unsuitable to disposal in flush toilets, etc.

SUMMARY OF THE INVENTION

An object of the invention is to provide a water-decomposable fibrous sheet which is well decomposed in water and has good strength enough for wiper applications even though no binder is added thereto.

Another object of the invention is to provide a water-decomposable fibrous sheet which is safe for its application to the skin.

According to one aspect of the invention, a water-decomposable fibrous sheet may comprise fibers containing fibrillated rayon, the fibrillated rayon having primary fibers of a predetermined fiber length and microfibers extending from the primary fibers;

the fibrillated rayon including a first type of fibrillated rayon having a degree of beating of at most 700 cc, of which the length of the primary fibers falls between 1.8 mm and 4.0 mm at the peak of its self-weighted, average fiber length distribution profile curve, and a second type of fibrillated rayon having a degree of beating of at most 700 cc, of which the length of the primary fibers falls between 4.5 mm and 10.0 mm at the peak of its self-weighted, average fiber length distribution profile curve, and the microfibers extending from the first and second types of fibrillated rayon being entangled with and/or hydrogen-bonded to at least either of other microfibers and other fibers.

Naturally in dry and even in wet with water, the water-decomposable fibrous sheet of the invention all the time keeps high strength. When it is immersed in a large amount of water after used and disposed of in toilets and others, it is readily decomposed. In the fibrous sheet of the invention, the microfibers of fibrillated rayon are entangled with and are further hydrogen-bonded to other fibers and other microfibers therein, thereby exhibiting their ability to bond fibers constituting the sheet and to enhance the strength of the sheet. When the fibrous sheet receives a large amount of water applied thereto, the entangled microfibers therein are loosened or the hydrogen bonds between the bonded microfibers therein are broken, whereby the fibrous sheet is readily decomposed in water. In particular, in the fibrous sheet of the invention, used are the first type of fibrillated rayon of short fibers and the second type of fibrillated rayon of long fibers. Therefore, the fibrous sheet realizes well-balanced decomposability in water, dry strength and wet strength.

The water-decomposable fibrous sheet of the invention can be composed of materials not harmful to human bodies.

In the fibrous sheet, preferably, the microfibers having a length of at most 1 mm in the first and second types of fibrillated rayon account for from 0.1 to 65% by mass of the self-weight of the fibrillated rayon.

The fibrous sheet may contain each of the first and second types of fibrillated rayon in an amount of at least 3% by mass of all the fibers constituting the fibrous sheet. Preferably, it contains at least 5% by mass of other fibers having a length of at most 10 mm, in addition to the fibrillated rayon.

The fibrous sheet may be a non-woven fabric having been subjected to water-jetting treatment. Alternatively, it may be produced in a paper-making process.

Preferably, the degree of fineness of the fibrillated rayon falls between 1.1 and 1.9 dtex.

Also preferably, the weight (this may be referred to as "Metsuke") of the fibers constituting the fibrous sheet falls between 20 and 100 g/m$^2$.

Still preferably, the decomposability in water of the fibrous sheet, measured according to JIS P-4501, is at most 200 seconds.

Still preferably, the wet strength of the fibrous sheet is at least 1.1 N/25 mm.

Also preferably, the dry strength of the fibrous sheet is at least 3.4 N/25 mm.

DESCRIPTION OF THE PREFERRED EMBODIMENTS

The fibrillated rayon for use in the invention is meant to indicate fibers of regenerated cellulose rayon having finely-fibrillated surfaces, or that is, those with submicron-sized microfibers having peeled and extending from the surfaces of the primary fibers (of the fibrillated rayon). The surface of ordinary regenerated cellulose is smooth, while that of the fibrillated rayon is fibrillated; and the two have different structures.

The fibrillated fibers of that type can be produced, for example, by mechanically processing rayon while it has absorbed water and is still wetted. Concretely, they may be produced, for example, according to a method of strongly stirring rayon in water in a mixer, or a method of beating rayon in a pulper, a refiner, a beater or the like (this is a wet-beating method). More precisely, the fibrillated rayon includes fibers as produced by processing wet-spun rayon such as polynosic or the like with an acid followed by mechanically fibrillating it, and fibers as produced by mechanically fibrillating solvent-spun rayon, etc. It should be noted that the fibrillated rayon can also be produced from ordinary, wet-spun regenerated cellulose.

The fibrillated rayon to be used in the fibrous sheet of the invention includes different types of fibrillated rayon of different fiber length profiles, a first type of fibrillated rayon and a second type of fibrillated rayon. In the fibrous sheet, the second type of fibrillated rayon of long fibers ensures the strength of the sheet, and the first type of fibrillated rayon of short fibers increases the strength, not lowering the decomposability in water of the sheet. As a result, the fibrous sheet realizes both good strength and good decomposability in water.

To specifically define the first and second types of fibrillated rayon capable of being preferably used in the invention, some methods may be employed. One is to analyze the self-weighted, average fiber length distribution (the mass distribution) of the primary fibers and the microfibers constituting fibrillated rayon. The self-weighted, average fiber length may be referred to as the weighted average length by weight. The microfibers are shorter than the primary fibers. Therefore, analyzing the distribution of the fiber length in fibrillated rayon clarifies the self-weighted, average fiber length distribution of the primary fibers and the microfibers constituting the fibrillated rayon. Another method of specifically defining the intended fibrillated rayon is based on the degree of beating rayon into fibrillated rayon (CSF; Canadian Standard Freeness).

Figure 1:
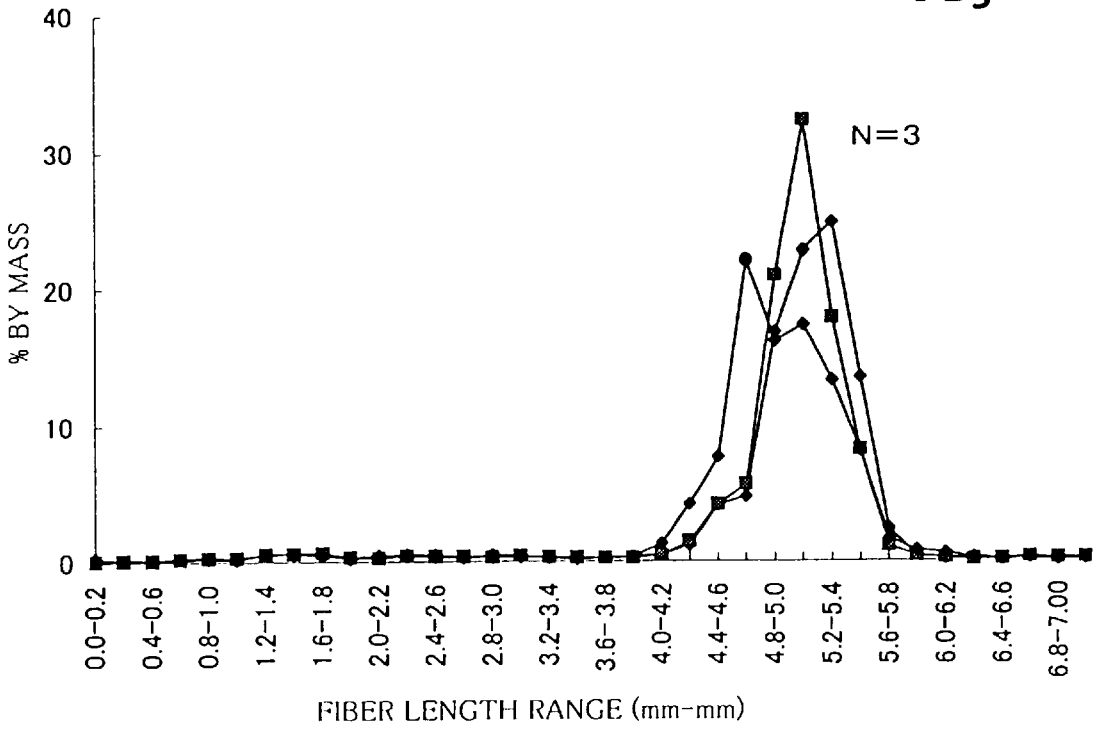
FIG. 1 is a graph showing the self-weighted, average fiber length distribution profile of the fiber length of non-beaten rayon.

First described is the self-weighted, average fiber length distribution of the primary fibers and the microfibers constituting fibrillated rayon. For this, referred to is one example of beating rayon of which the original fiber length is 5 mm, into fibrillated rayon of the second type. The self-weighted, average fiber length distribution profile of non-beaten, non-fibrillated rayon (CSF=740 cc, fiber length 5 mm, 1.7 dtex), for which n=3, is shown in FIG. 1. As in FIG. 1, the self-weighted, average fiber length distribution in non-beaten rayon is almost concentrated in the fiber length range of 5 mm±1 mm or so. Non-beaten rayon samples all having a concentration of 0.75% by mass were prepared and beaten in wet to different degrees in a mixer. The self-weighted, average fiber length distribution of the thus-beaten, fibrillated rayon was analyzed in relation to the different fiber lengths. The resulting data are plotted to give a graph of FIG. 2.

Figure 2:
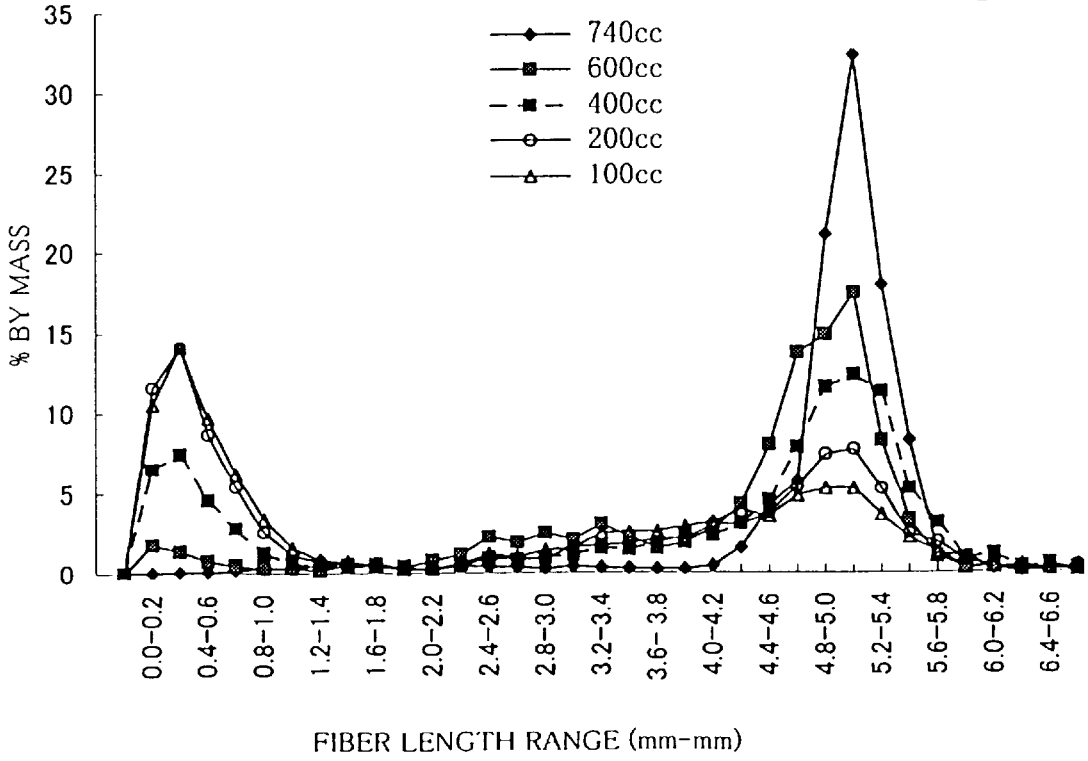
FIG. 2 is a graph showing the self-weighted, average fiber length distribution profile of the fiber length of beaten rayon, for which rayon having a fiber length of 5 mm was beaten.

As seen in FIG. 2, the self-weighted, average fiber length distribution profile of the fibrillated rayon gave two apparent peaks. Regarding its details, the area except that for fiber lengths of shorter than 1 mm is principally for the primary fibers of the fibrillated rayon, and the remaining area for fiber lengths of shorter than 1 mm includes long extending microfibers and chopped rayon fibers all resulting from too much promoted fibrillation. The fiber length of the primary fibers of the beaten, fibrillated rayon may be shorter in some degree than that of the fibers of the original, non-beaten rayon, or may be seemingly longer in some degree owing to the microfibers that extend from the primary fibers at their ends. Accordingly, in the beaten, fibrillated rayon, the fiber length of the primary fibers corresponding to the peak of the self-weighted, average fiber length distribution profile and around it falls within a range of the nominal fiber length of the non-beaten rayon ±0.5 mm or so, more precisely, within a range between the length of the primary fibers −0.3 mm and the length of the primary fibers or so.

To that effect, the fibrillated rayon for use in the invention is identified as one having the fiber length peak for the primary fibers of the fibrillated rayon itself and the fiber length peak for the fibrillated microfibers. Especially preferably, the microfibers having a length of at most 1 mm in the fibrillated rayon for use in the invention account for from 0.1 to 65% by mass of the self-weight of the fibrillated rayon.

Figure 3:
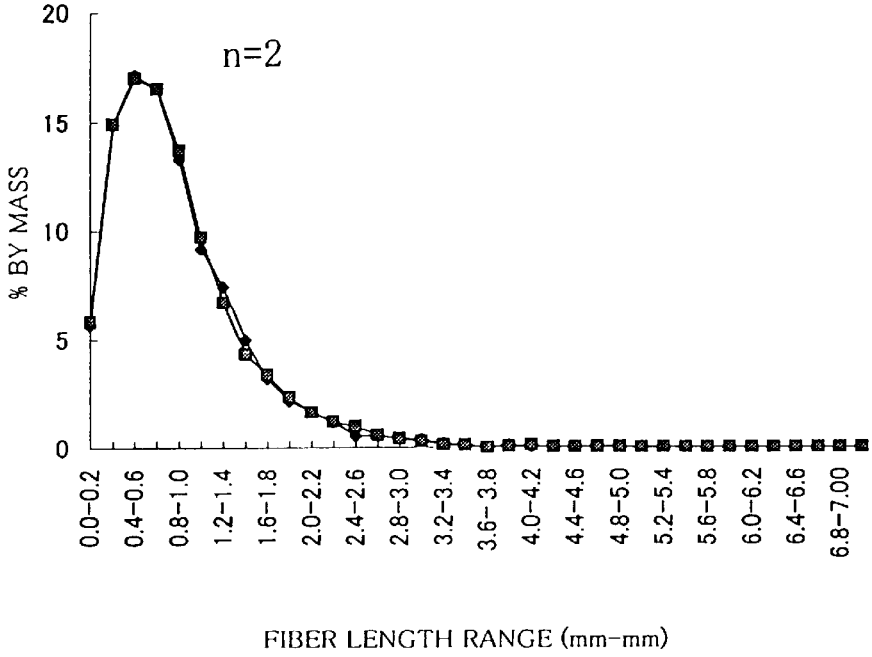
FIG. 3 is a graph showing the self-weighted, average fiber length distribution profile of the fiber length of rayon having been free-beaten.
Figure 4:
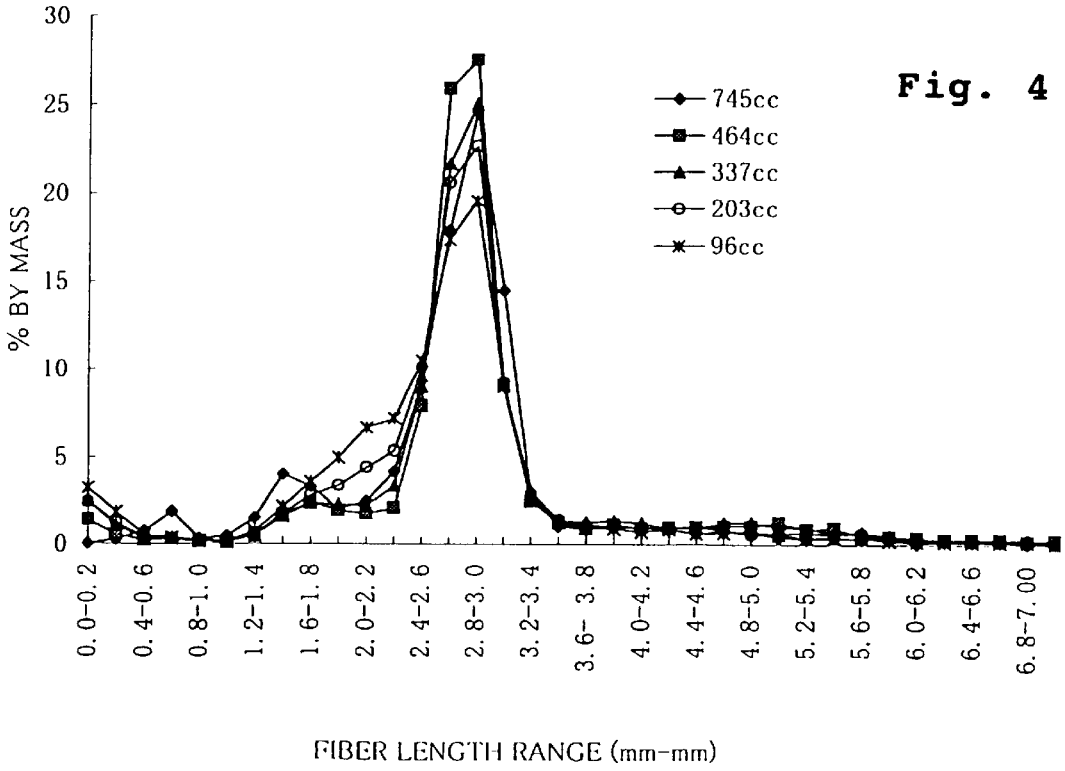
FIG. 4 is a graph showing the self-weighted, average fiber length distribution profile of the fiber length of beaten rayon, for which rayon having a fiber length of 3 mm was beaten in wet.
Figure 5:
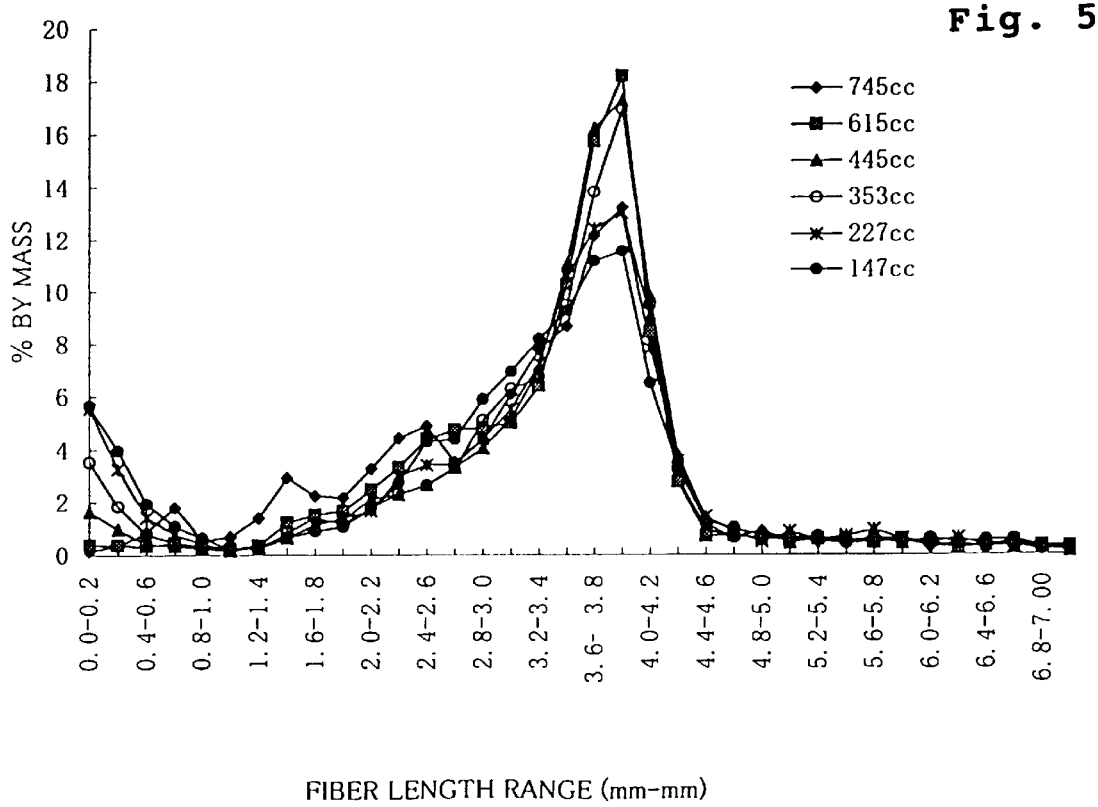
FIG. 5 is a graph showing the self-weighted, average fiber length distribution profile of the fiber length of beaten rayon, for which rayon having a fiber length of 4 mm was beaten in wet.
Figure 6:
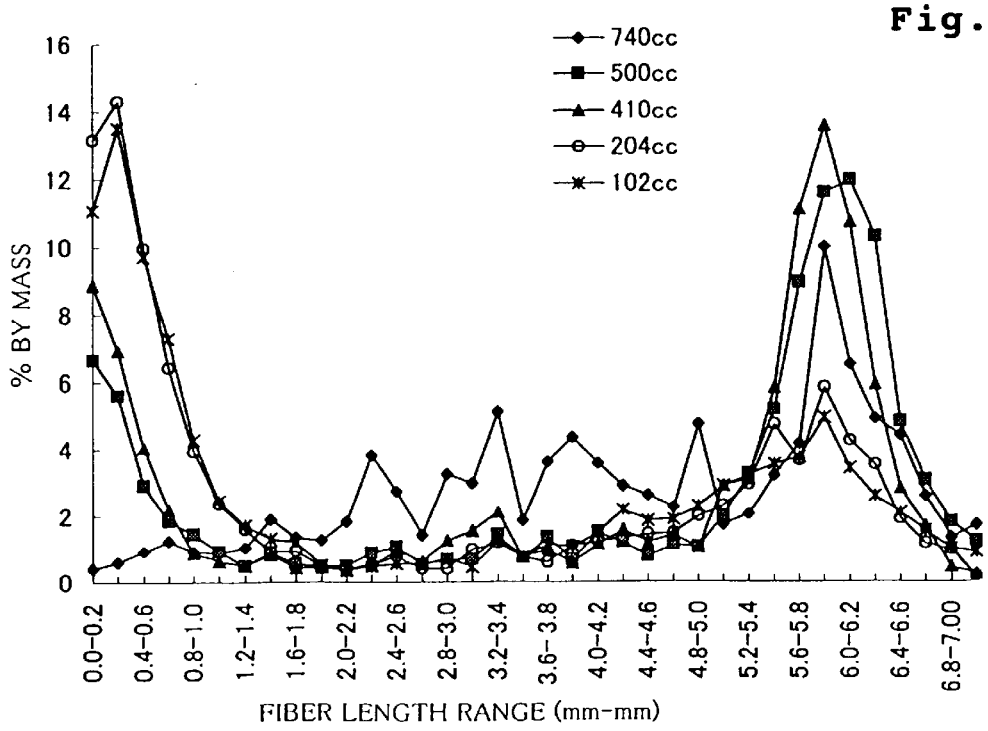
FIG. 6 is a graph showing the self-weighted, average fiber length distribution profile of the fiber length of beaten rayon, for which rayon having a fiber length of 6 mm was beaten in wet.
Figure 7:
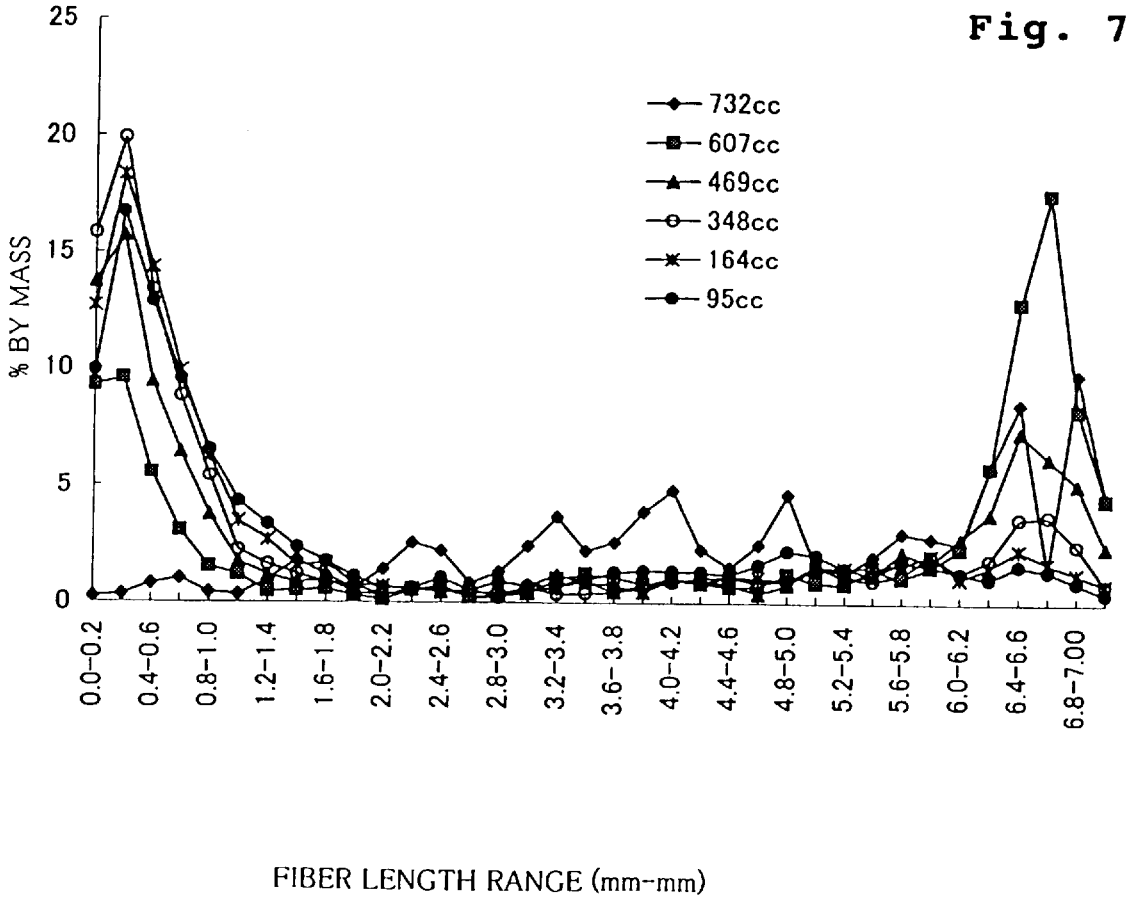
FIG. 7 is a graph showing the self-weighted, average fiber length distribution profile of the fiber length of beaten rayon, for which rayon having a fiber length of 7 mm was beaten in wet.

The fibrillated rayon is prepared by beating rayon in wet, as set forth above. If, being different from this, rayon is beaten in an ordinary free-beating manner to promote its beating (so that the beaten rayon shall have a reduced numerical value indicating its degree of beating), it will be entirely pulverized into small particles, as in FIG. 3. In that condition, most of the small particles would lose the original fiber length. The free-beaten rayon is not within the scope of the fibrillated rayon for use in the invention.

The water-decomposable fibrous sheet of the invention contains the first type of fibrillated rayon of which the length of the primary fibers falls between 1.8 mm and 4.0 mm at the peak of its self-weighted, average fiber length distribution profile curve and therearound, and the second type of fibrillated rayon of which the length of the primary fibers falls between 4.5mm and 10.0 mm at the peak of its self-weighted, average fiber length distribution profile curve and therearound. Though containing the first type of fibrillated rayon of relatively short fibers, the fibrous sheet can ensure the strength owing to the microfibers of the first type of fibrillated rayon and to the primary fibers and the microfibers of the second type of fibrillated rayon therein. On the other hand, when the fibrous sheet is brought into contact with a large amount of water applied thereto, the entangled fibers therein are readily loosened and the sheet decomposes in water within a short period of time. This is because the fibrous sheet contains the first type of fibrillated rayon of short fibers. In that manner, the water-decomposable fibrous sheet of the invention contains different types of fibrillated rayon of different fiber length profiles, and therefore its decomposability in water and strength can be well balanced with no difficulty.

In case where the primary fibers of the first type of fibrillated rayon are shorter than the lowermost limit of the defined range, the microfibers extending from the primary fibers could not be entangled to the necessary degree, so that the wet strength of the non-woven fabric for the fibrous sheet will be low; but in case where the primary fibers are longer than the uppermost limit of the defined range, the fibrous sheet will hardly decompose in water. On the other hand, in case where the primary fibers of the second type of fibrillated rayon are longer than the uppermost limit of the defined range at the peak of the self-weighted, average fiber length distribution profile curve and therearound of the fibrillated rayon, not only the microfibers but also the primary fibers of the fibrillated rayon will be entangled with each other, or the primary fibers will be further entangled with other fibers. If so, the decomposability of the fibrous sheet in water will be poor.

The self-weighted, average fiber length distribution of fibrillated rayon depends on both the original fiber length of the non-beaten rayon and on the degree of beating the non-beaten rayon. Preferred examples of the first and second types of fibrillated rayon for use in the invention are shown in Table 1 and Table 2.

TABLE 1

| First Type of Fibrillated Rayon | | | | |
|---|---|---|---|---|
| | | | Mass Distribution | |
| Beating Method | Fiber Length and dtex of Non-beaten Rayon | Degree of Beating (cc) | Fibers not longer than 1.0 mm (% by mass) | Fiber Length of Primary Fibers*1 (% by mass) |
| mixer | 3 mm | 464 | 2.61 | 72.84 |
| | 1.7 dtex | 337 | 4.40 | 67.89 |
| | | 203 | 4.49 | 65.35 |
| | | 96 | 6.31 | 58.86 |
| | 4 mm | 615 | 1.85 | 55.19 |
| | 1.7 dtex | 445 | 3.70 | 58.02 |
| | | 353 | 7.02 | 59.58 |
| | | 227 | 11.47 | 47.23 |
| | | 147 | 13.28 | 41.51 |
| refiner or pulper | 3 mm | 644 | 0.57 | |
| | 1.4 dtex | 626 | 0.46 | |
| | | 595 | 0.40 | |
| | | 563 | 0.78 | |
| | | 480 | 0.71 | |
| | | 407 | 0.69 | |
| | | 352 | 0.87 | |
| | | 340 | 1.05 | |
| | | 297 | 1.32 | |
| | | 241 | 1.39 | |
| | | 211 | 1.77 | |
| | 3 mm | 653 | 0.16 | |
| | 1.7 dtex | 584 | 0.23 | |
| | | 472 | 0.43 | |
| | | 372 | 0.59 | |
| | | 333 | 0.63 | |
| | | 291 | 1.13 | |
| | | 259 | 1.25 | |
| | | 212 | 1.54 | |
| | | 176 | 1.92 | |
| | | 163 | 3.61 | |

*1 With non-beaten rayon having a fiber length of 3 mm, the length of the primary fibers in the beaten rayon falls between 2.4 mm and 3.4 mm; and with that having a fiber length of 4 mm, it falls between 3.4 mm and 4.4 mm.

TABLE 2

Second Type of Fibrillated Rayon

| Beating Method | Fiber Length and dtex of Non-beaten Rayon | Degree of Beating (cc) | Mass Distribution: Fibers not longer than 1.0 mm (% by mass) | Mass Distribution: Fiber Length of Primary Fibers*2 (% by mass) |
|---|---|---|---|---|
| mixer | 5 mm | 600 | 4.06 | 63.80 |
| | 1.7 dtex | 400 | 22.49 | 47.25 |
| | | 200 | 35.95 | 32.77 |
| | | 100 | 41.76 | 22.72 |
| | 6 mm | 500 | 18.45 | 47.78 |
| | 1.7 dtex | 410 | 22.90 | 46.98 |
| | | 204 | 47.74 | 21.85 |
| | | 102 | 45.81 | 18.12 |
| | 7 mm | 607 | 28.98 | 43.07 |
| | 1.7 dtex | 469 | 49.06 | 24.96 |
| | | 348 | 63.29 | 10.72 |
| | | 164 | 61.53 | 6.19 |
| | | 95 | 55.58 | 4.39 |
| | 5 mm | 520 | 12.77 | |
| | 1.7 dtex | 377 | 23.20 | |
| | | 185 | 39.37 | |
| | | 67 | 35.47 | |

| Beating Method | Fiber Length and dtex of Non-beaten Rayon | Degree of Beating (cc) | Mass Distribution Fibers not longer than 1.0 mm (% by mass) |
|---|---|---|---|
| refiner or pulper | 5 mm | 676 | 1.08 |
| | 1.4 dtex | 646 | 1.06 |
| | | 631 | 2.08 |
| | | 554 | 8.48 |
| | | 433 | 7.39 |
| | | 339 | 11.18 |
| | | 242 | 21.57 |
| | | 183 | 20.43 |
| | | 161 | 26.55 |
| | | 135 | 24.32 |
| | 5 mm | 695 | 0.47 |
| | 1.7 dtex | 625 | 1.49 |
| | | 521 | 7.17 |
| | | 229 | 20.96 |
| | | 200 | 17.14 |
| | | 198 | 20.04 |
| | | 198 | 18.10 |
| | | 198 | 17.59 |
| | | 195 | 16.92 |
| | | 195 | 15.08 |
| | | 190 | 15.14 |
| | | 188 | 19.54 |
| | | 187 | 17.41 |
| | | 186 | 13.94 |

*2 With non-beaten rayon having a fiber length of 5 mm, the length of the primary fibers in the beaten rayon falls between 4.4 mm and 5.4 mm; With that having a fiber length of 6 mm, it falls between 5.4 mm and 6.4 mm; and with that having a fiber length of 7 mm, it falls between 6.4 mm and 7.2 mm.

Table 1 shows the data from rayon having a fiber length of 3 mm or 4 mm; and Table 2 shows the data from rayon having a fiber length of 5 mm, 6 mm or 7 mm. The rayon was beaten in wet to different degrees of beating in a mixer or a refiner (or in a pulper). The data in these Tables indicate the self-weighted, average fiber length distribution of the fibers of not longer than 1.0 mm, principally microfibers (that is, the proportion of microfibers) and the self-weighted, average fiber length distribution of the primary fibers of which the length is near to the fiber length of the non-beaten rayon (falling within a range of from −0.6 mm to +0.4 mm of the original fiber length of the non-beaten rayon) in the resulting first and second types of fibrillated rayon. The data of the fibrillated rayon obtained through beating in a mixer are plotted to give graphs as in FIGS. 4 to 7, which show the self-weighted, average fiber length distribution profiles of the fibrillated rayon.

From the above, it is understood that the first type of fibrillated rayon, of which the length of the primary fibers falls between 1.8 mm and 4.0 mm at the peak of its self-weighted, average fiber length distribution profile curve and therearound, is formed from non-beaten rayon having a fiber length of from 2.0 to 4.5 mm or so, and that the second type of fibrillated rayon, of which the length of the primary fibers falls between 4.5 mm and 10.0 mm at the peak of its self-weighted, average fiber length distribution profile curve and therearound, is formed from non-beaten rayon having a fiber length of from 5 to 10.5 mm or so.

In the preferred samples of the first type of fibrillated rayon formed from non-beaten rayon having a fiber length of 3 mm (in these, the self-weighted, average fiber length distribution peak for the primary fibers in the beaten rayon appears within a fiber length range of from 2.5 to 3 mm), the microfibers having a length of at most 1 mm account for from 0.1 to 10% by mass of the self-weight of the fibrillated rayon. However, in the samples having been beaten in a pulper or a refiner, the uppermost limit of the microfibers is 5% by mass or so; and in those having been beaten to a degree of beating of at most 600 cc, the lowermost limit thereof is 0.2% by mass.

In the samples of the first type of fibrillated rayon formed from non-beaten rayon having a fiber length of 4 mm (in these, the self-weighted, average fiber length distribution peak for the primary fibers appears within a fiber length range of from 3.5 to 4.0 mm), the microfibers having a length of at most 1 mm account for from 1 to 14% by mass of the self-weight of the fibrillated rayon. However, in the samples having been beaten in a pulper or a refiner, the microfibers account for from 0.3 to 10% by mass or so; and in those having been beaten in a pulper or a refiner to a degree of beating of at most 600 cc, the lowermost limit of the microfibers is 0.5% by mass.

Accordingly, in the first type of fibrillated rayon, it is desirable that the microfibers having a length of at most 1 mm account for from 0.1 to 14.0% by mass of the self-weight of the first type of fibrillated rayon. Also preferably, in the first type of fibrillated rayon having a degree of beating of smaller than 400 cc, the microfibers having a length of at most 1 mm account for from 0.4 to 14% by mass of the self-weight of the first type of fibrillated rayon; and in that having a degree of beating of from 400 cc to 700 cc, the microfibers having a length of at most 1 mm account for from 0.1 to 4.0% by mass of the fist type of fibrillated rayon.

On the other hand, in the preferred samples of the second type of fibrillated rayon formed from non-beaten rayon having a fiber length of 5 mm (in these, the self-weighted, average fiber length distribution peak for the primary fibers in the beaten rayon appears within a fiber length range of from 4.5 to 5.0 mm), the microfibers having a length of at most 1 mm account for from 0.3 to 45% by mass of the self-weight of the fibrillated rayon. However, in the samples having been beaten in a pulper or a refiner, the uppermost limit of the microfibers is 30% by mass or so; and in those having been beaten in a pulper or a refiner to a degree of beating of at most 600 cc, the lowermost limit thereof is 5% by mass.

In the samples of the second type of fibrillated rayon from non-beaten rayon having a fiber length of 6 mm (in these, the self-weighted, average fiber length distribution peak for the primary fibers appears within a fiber length range of from 5.5 to 6.0 mm), the microfibers having a length of at most 1 mm account for from 5 to 50% by mass of the self-weight of the second type of fibrillated rayon. However, in the samples having been beaten in a pulper or a refiner, the microfibers account for from 0.5 to 30% by mass or so; and in those having been beaten in a pulper or a refiner to a degree of beating of at most 600 cc, the lowermost limit of the microfibers is 5% by mass.

In the samples of the second type of fibrillated rayon from non-beaten rayon having a fiber length of 7 mm (in these, the self-weighted, average fiber length distribution peak for the primary fibers appears within a fiber length range of from 6.5 to 7.0 mm), the microfibers having a length of at most 1 mm account for from 10 to 65% by mass of the self-weight of the fibrillated rayon. However, in the samples having been beaten in a pulper or a refiner, the microfibers account for from 3 to 50% by mass or so; and in those having been beaten in a pulper or a refiner to a degree of beating of at most 600 cc, the lowermost limit of the microfibers is 8% by mass.

Accordingly, in the second type of fibrillated rayon, it is desirable that the microfibers having a length of at most 1 mm account for from 0.3 to 65.0% by mass of the self-weight of the second type of fibrillated rayon. Also preferably, in the second type of fibrillated rayon having a degree of beating of smaller than 400 cc, the microfibers having a length of at most 1 mm account for from 8 to 65% by mass of the self-weight of the second type of fibrillated rayon; and in that having a degree of beating of from 400 cc to 700 cc, the microfibers having a length of at most 1 mm account for from 0.3 to 50% by mass of the second type of fibrillated rayon.

The degree of beating of the first and second types of fibrillated rayon preferred for use in the invention is described. The degree of beating to give fibrillated rayon can be controlled by varying the beating time and by selecting the beating means of a mixer, a pulper or a refiner. Where beating rayon is promoted (to give a beaten, fibrillated rayon that shall have a lowered numerical value indicating its degree of beating), the ratio of short fibers (including microfibers) in self-weighted, average fiber length distribution of the resulting fibrillated rayon will increase. In the invention, the first and second types of fibrillated rayon both have a degree of beating of at most 700 cc. Fibrillated rayon having a degree of beating of larger than 700 cc contains a small amount of microfibers formed therein and therefore could not have a strength necessary for fibrous sheets. More preferably, the fibrillated rayon for use herein has a degree of beating of at most 600 cc. These types of fibrillated rayon are preferred, since the microfibers constituting them significantly enhance the strength of the fibrous sheet that comprises them. Even more preferably, the degree of beating is at most 400 cc. Even when two types of fibrillated rayon having a degree of beating of at most 200 cc, or even at most 100 cc (for example, 50 cc or 0 cc) are used for sheet production, the water-decomposable fibrous sheet produced and comprising them could have well-balanced wet strength and decomposability in water.

Preferably, the degree of beating of the first type of fibrillated rayon is smaller than that of the second type of fibrillated rayon, or that is, the first type of fibrillated rayon it beaten to a higher degree than the second type of fibrillated rayon. In the preferred first type of fibrillated rayon of which the primary fibers are shorter than those in the second type of fibrillated rayon, a larger amount of microfibers could extend from the primary fibers, thereby more effectively enhancing the strength of the fibrous sheet comprising the preferred types of fibrillated rayon without detracting from the decomposability in water of the sheet.

The fineness of the first and second types of fibrillated rayon in terms of denier is preferably from 1 to 7 d (denier), that is, from 1.1 to 7.7 dtex or so. If their fineness is smaller than the lowermost limit of the defined range, the primary fibers of the fibrillated rayon will be too much entangled, and the decomposability in water of the fibrous sheet comprising them will be poor. On the other hand, if their fineness is larger than the uppermost limit of the defined range, the formation of the fibrous sheet will be not good and, in addition, the productivity thereof will be low. More preferably, the fineness falls between 1.1 and 1.9 dtex.

Preferably, the fineness of the first type of fibrillated rayon is the same as or smaller (finer) than that of the second type of fibrillated rayon. The first type of fibrillated rayon of the preferred case could serve more effectively as a binder for fibers, thereby more highly enhancing the strength of the fibrous sheet comprising the preferred types of fibrillated rayon without detracting from the decomposability in water of the sheet.

Also preferably, the blending amount of the first and second types of fibrillated rayon to be in the fibrous sheet of the invention is at least 3% by mass of all fibers constituting the fibrous sheet. More preferably, the amount of the first type of fibrillated rayon therein is at least 5% by mass of all fibers constituting the fibrous sheet, and that of the second type of fibrillated rayon therein is at least 5% by mass of all fibers constituting the fibrous sheet. Even more preferably, each of the first and second types of fibrillated rayon accounts for at least 10% by mass of the fibrous sheet.

In the fibrous sheet, it is desirable that the blend ratio of the first type of fibrillated rayon to the second type thereof, that is, the first type of fibrillated rayon:the second type of fibrillated rayon falls between 1:9 and 9:1, more preferably between 3:7 and 7:3.

The water-decomposable fibrous sheet of the invention may be made from only the first and second types of fibrillated rayon, but may contain any other fibers in addition to the two types of fibrillated rayon. For example, it may contain third and fourth types of fibrillated rayon, in addition to the first and second types of fibrillated rayon. In this case, it is desirable that the primary fibers of all types of fibrillated rayon have a length falling between 1.8 mm and 12.0 mm at the peak of the self-weighted, average fiber length distribution profile curve of the fibrillated rayon and therearound, and that the microfibers having a length of at most 1 mm and extending from the primary fibers account for from 0.1 to 65% by weight of the self-weight of the fibrillated rayon. Also preferably, all types of fibrillated rayon to be used in the fibrous sheet have a degree of beating of at most 700 cc.

The water-decomposable fibrous sheet of the invention may contain any other fibers having a length of at most 10 mm, in addition to the fibrillated rayon mentioned above. In case where the fibrous sheet is formed from the fibrillated rayon and such other fibers, the microfibers of the fibrillated rayon could be entangled with the other fibers to thereby ensure the strength of the sheet. The entangled microfibers and other fibers are readily loosened when a large amount of water is applied to the fibrous sheet, thereby ensuring the good decomposability of the sheet in water.

Preferably, the other fibers having a length of at most 10 mm are well dispersible in water, or that is, water-dispersible fibers are preferred for them. The dispersibility in water referred to herein has the same meaning as the decomposability in water, and is meant to indicate that the fibers are dispersed well in water to thereby decompose the sheet comprising them, when kept in contact with a large amount of water. More preferably, the other fibers are biodegradable fibers. The biodegradable fibers naturally decompose by themselves when disposed of in the natural world. The fiber length of the other fibers for use herein is meant to indicate the mean fiber length thereof. Further preferably, the other fibers having a fiber length of at most 10 mm have a length (in terms of the mean fiber length) of at least 1 mm.

The other fibers for use in the invention may be those of at least one sort selected from the group consisting of natural fibers and chemical fibers. The natural fibers include those from wood pulp such as soft wood pulp, hard wood pulp, etc.; and also those from Manila hemp, linter pulp, etc. These natural fibers are biodegradable. Of those, preferred are bleached soft-wood kraft pulp, and bleached hard-wood kraft pulp, as having high dispersibility in water. Also usable herein are chemical fibers such as regenerated fibers of rayon, etc.; synthetic fibers of polypropylene, polyvinyl alcohol, polyester, polyacrylonitrile, etc.; biodegradable synthetic fibers; synthetic pulp of polyethylene, etc. Of those, preferred is rayon, as being biodegradable. Further usable are still other biodegradable fibers of polylactic acid, polycaprolactone, aliphatic polyesters such as polybutylene succinate, polyvinyl alcohol, collagen, etc. Needless-to-say, any fibers other than those mentioned above are usable herein so far as they are dispersible in water.

For the soft wood pulp, its degree of beating preferably falls between 500 and 750 cc or so. If its degree of beating is smaller than-the lowermost limit of the defined range, the non-woven fabric comprising the pulp will have a paper-like morphology, and will have a rough feel. If, however, its degree of beating is larger than the uppermost limit of the defined range, the non-woven fabric comprising the pulp could not have the necessary strength.

In case where the water-decomposable fibrous sheet of the invention is composed of the first and second types of fibrillated rayon and such other fibers having a length of at most 10 mm, the blend ratio of the fiber is such that the amount of the first type of fibrillated rayon is from 5 to 85% by mass, that of the second type of fibrillated rayon is from 5 to 85% by mass and that of the other fibers is from 5 to 85% by mass (100% by mass in total). Preferably, the blend ratio of the fiber is such that the amount of the first type of fibrillated rayon is from 10 to 70% by mass, that of the second type of fibrillated rayon is from 10 to 70% by mass and that of the other fibers is from 10 to 70% by mass. More preferably, the blend ratio of the fiber is such that the amount of the first type of fibrillated rayon is from 20 to 60% by mass, that of the second type of fibrillated rayon is from 20 to 60% by mass and that of the other fibers is from 10 to 30% by mass.

The fibers mentioned above are formed into the fibrous sheet of the invention. For example, they are formed into a fibrous web through a paper-making process or the like, and optionally the fibrous web is further processed with water jets into a non-woven fabric. The fibrous sheet of the invention may be any of such fibrous webs or non-woven fabrics.

Preferably, the weight (Metsuke) of the fibrous web for the fibrous sheet of the invention falls between 20 and 100 $g/m^2$, in order that the sheet can bear wiping in wet and is favorable to the top sheet for absorbent articles. If its weight is smaller than the lowermost limit of the defined range, the sheet could not have the necessary wet strength. If, however, its weight is larger than the uppermost limit of the defined range, the sheet will be not flexible. In particular, for application to the skin of human bodies, the weight of the sheet is more preferably from 30 to 70 $g/m^2$, in view of the wet strength and the soft feel of the sheet. If desired, a plurality of fibrous webs each having a weight of from 15 to 25 $g/m^2$ or so may be laminated and integrated to give the fibrous sheet of the invention.

The water-decomposable fibrous sheet of the invention may be used directly after it has been produced in a wet paper-making process or the like. The dry strength of the water-decomposable fibrous sheet could be specifically increased owing to the hydrogen bonding at the OH groups existing on the surfaces of the fibrillated rayon fibers in the sheet. With the increase in the degree of fibrillation of rayon fibers in the sheet, or that is, with the increase in the amount of microfibers therein, the surface area of the fibers constituting the sheet increases and the fiber-to-fiber bonding strength of hydrogen bonds in the sheet is thereby enhanced. In the sheet produced in a paper-making process and not processed with water jets, the hydrogen-bonding force of the microfibers is comparable to or larger than that of pulp, so that the sheet strength is high. Depending on the hydrogen-bonding force of the microfibers constituting the sheet, the decomposability in water of the sheet could be well balanced with the mechanical strength thereof. The dry strength of the sheet produced in a paper-making process is especially high. Even in the sheet produced in a paper-making process, the microfibers can be partly entangled, so that the wet strength of the sheet can be high.

For more surely increasing its wet strength, the fibrous sheet is preferably in the form of a non-woven fabric that may be produced by forming a fibrous web, for example, in a wet process, followed by subjecting the fibrous web to water-jetting treatment. The fibrous web may also be prepared in a dry process, and may be subjected to water-jetting treatment. For water-jetting treatment, employed is an ordinary high-pressure water-jetting device. Through water-jetting treatment, the microfibers extending from the fibrillated rayon in the thus-processed fibrous web are entangled with at least either of other microfibers and other fibers, thereby increasing the tangling fiber-to-fiber force therein, and the dry strength of the processed fibrous web increases owing to the hydrogen-bonding force of the microfibers. Even though the hydrogen bonds therein are broken when the fibrous web is wetted, the fibrous web could still keep high wet strength as the microfibers therein are kept entangled. Through water-jetting treatment, the microfibers on the surfaces of the fibrillated rayon fibers are entangled with other fibers or microfibers. Accordingly, the fiber-tangling structure of the non-woven fabric having been processed through water-jetting treatment differs from that of an ordinary non-woven spun lace fabric in which the constituent fibers are entangled together by themselves.

The details of water-jetting treatment are described. A fibrous web to be processed is put on a continuously moving, mesh-type conveyor belt, and exposed to high-pressure water-jetting streams to such a degree that the streams applied thereto could pass from its top surface to its back surface. Through the water-jetting treatment, the properties of the non-woven fabric obtained are changed, depending on the weight of the fibrous web to be processed, the pore diameter of the jetting nozzle to be used, the number of pores of the jetting nozzle, the speed at which the fibrous web is processed with the water-jetting streams (processing speed), and the count of meshes of the conveyor belt used, etc. After having been formed, it is desirable that the-fibrous web is directly subjected to water-jetting treatment without being dried, for simplifying the process for the treatment. However, the fibrous web may be subjected to water-jetting treatment after having been once dried.

Preferably, the strength at break in wet of the water-decomposable fibrous sheet of the invention that contains water is at least 1.1 N/25 mm in terms of the root mean square of the strength in the machine direction (MD) of the non-woven fabric for the sheet and that in the cross direction (CD) thereof. The strength at break in wet (this is herein referred to as wet strength) is meant to indicate the tensile strength at break (N) of the fibrous sheet in wet. To obtain its wet strength in terms of the tensile strength at break, a piece of the fibrous sheet having a width of 25 mm and a length of 150 mm is immersed in water to thereby infiltrate water of 2.5 times the mass of the sheet into the sheet piece, and the thus-wetted sheet piece is pulled until it is broken, by the use of a Tensilon tester, for which the chuck distance is 100 mm and the stress rate is 100 mm/min. However, the data thus measured according to the method are merely the criterion for the strength of the fibrous sheet, and the fibrous sheet of the invention will have a strength that is substantially the same as the wet strength thereof measured in the manner as above. More preferably, the wet strength of the fibrous sheet is at least 1.3 N/25 mm.

On the other hand, it is also desirable that the fibrous sheet has high strength enough for its use even in dry. Therefore, the dry strength of the fibrous sheet is preferably at least 3.4 N/25 mm in terms of the root mean square of the strength at break in the machine direction (MD) of the non-woven fabric for the sheet and that in the cross direction (CD) thereof.

Also preferably, the water-decomposable fibrous sheet of the invention has a degree of decomposition in water of at most 300 seconds, more preferably at most 200 seconds, even more preferably at most 120 seconds. The degree of decomposition in water is measured according to the test method of JIS P-4501 that indicates the degree of easy degradation of toilet paper in water. The outline of the paper degradation test method is described. A piece of the water-decomposable fibrous sheet of the invention having a length of 10 cm and a width of 10 cm is put into a 300-ml beaker filled with 300 ml of ion-exchanged water, and stirred therein with a rotor. The revolution speed of the rotor is 600 rpm. The condition of the test piece being dispersed in water is macroscopically observed at predetermined time intervals, and the time until the test piece is finely dispersed is measured.

However, the data thus measured according to the method are merely the criterion for the decomposability in water of the fibrous sheet, and the fibrous sheet of the invention will have a degree of decomposition in water that is substantially the same as the data measured in the manner as above.

To make the water-decomposable fibrous sheet of the invention have a degree of decomposition in water and a degree of wet strength that fall within the preferred ranges noted above, the type of the fibers constituting the sheet, the proportion of the fibers, the weight of the sheet, and the conditions for water-jetting treatment for the sheet may be varied. For example, in case where the proportion of the second type of fibrillated rayon of longer fibers is increased in the fibrous sheet, or where the first and second types of fibrillated rayon in the fibrous sheet are not beaten so much (that is, these types of fibrillated rayon both have an increased numerical value indicating their degree of beating), the weight of the fibrous sheet is reduced, or the processing energy for water-jetting treatment is reduced, whereby the fibrous sheet could have an increased degree of decomposition in water and an increased wet strength.

Even though not containing a binder, the water-decomposable fibrous sheet of the invention could have a high degree of decomposition in water and a high wet strength. However, in order to further increase the wet strength of the fibrous sheet, a water-soluble or water-swellable binder capable of binding fibers together may be added to the sheet. Having met a large amount of water, the binder shall dissolve or swell therein and therefore lose its fiber-binding ability. The binder usable herein includes, for example, carboxymethyl cellulose; alkyl celluloses such as methyl cellulose, ethyl cellulose, benzyl cellulose, etc.; polyvinyl alcohol; modified polyvinyl alcohols having a predetermined amount of a sulfonic acid group or a carboxyl group, etc. The amount of the binder to be added to the fibrous sheet may be smaller than usually. For example, only about 2 g of the binder, relative to 100 g of the fibers constituting the fibrous sheet, may be added to the sheet whereby the wet strength of the sheet could be increased to a satisfactory degree. Accordingly, adding such a small amount of a binder to the fibrous sheet does not so much interfere with the safety of the sheet. To add a water-soluble binder to the non-woven fabric for the fibrous sheet, employable is a coating method of applying the binder to the non-woven fabric through a silk screen. On the other hand, a water-swellable binder may be added to the fibrous web for the sheet while the fibrous web is prepared in a paper-making process.

Where a binder such as that mentioned above is added to the fibrous sheet of the invention, an electrolyte such as a water-soluble inorganic or organic salt may be added thereto along with the binder, whereby the wet strength of the sheet could be increased much more. The inorganic salt includes, for example, sodium sulfate, potassium sulfate, zinc sulfate, zinc nitrate, potassium alum, sodium chloride, aluminium sulfate, magnesium sulfate, potassium chloride, sodium carbonate, sodium hydrogencarbonate, ammonium carbonate, etc.; and the organic salt includes, for example, sodium pyrrolidone-carboxylate, sodium citrate, potassium citrate, sodium tartrate, potassium tartrate, sodium lactate, sodium succinate, potassium pantothenate, calcium lactate, sodium laurylsulfate, etc. Where an alkyl cellulose is used as the binder, it is preferably combined with a monovalent salt. Where a modified or non-modified polyvinyl alcohol is used as the binder, it is preferably combined with a monovalent salt.

In addition, where an alkyl cellulose is used as the binder, any of the following compounds may be added to the water-decomposable fibrous sheet so as to further increase the strength of the sheet. The additional compounds include, for example, copolymers of a polymerizable acid anhydride monomer with other comonomers, such as (meth)acrylic acid-maleic acid resins, (meth)acrylic acid-fumaric acid resins, etc. Preferably, the copolymers are saponified with sodium hydroxide or the like into water-soluble copolymers partially having a sodium carboxylate moiety. Adding an amino acid derivative such as trimethylglycine or the like to the sheet is also desirable, as also enhancing the strength of the sheet.

The water-decomposable fibrous sheet of the invention may optionally contain any other substances, without interfering with the advantages of the invention. For example, it may contain any of surfactants, microbicides, preservatives, deodorants, moisturizers, alcohols such as ethanol, polyalcohols such as glycerin, etc.

As having good decomposability in water and high wet strength, the water-decomposable fibrous sheet of the invention is usable as wet tissue for application to the skin of human bodies including the private parts thereof, or as cleaning sheets for toilets and thereabouts. To enhance its wiping and cleaning capabilities for those applications, the sheet may previously contain water, surfactant, alcohol, glycerin and the like. Where the water-decomposable fibrous sheet of the invention is, while being previously wetted with liquid detergent and the like, packaged for public sale, it shall be airtightly packaged and put on the market so that it is not spontaneously dried. On the other hand, the water-decomposable fibrous sheet may be marketed in dry. The users who have bought the dry water-decomposable fibrous sheet may wet it with water or liquid chemicals before use.

Since the water-decomposable fibrous sheet of the invention has high dry strength, and since it does not always require adding binders and electrolytes thereto, being different from conventional water-decomposable fibrous sheets, it is highly safe for its application to the skin. Accordingly, the fibrous sheet of the invention is usable as the sheet component of various water-decomposable absorbent articles including, for example, sanitary napkins, panty liners, sanitary tampons, disposable diapers, etc. For example, when the fibrous sheet is perforated, it may be used as the top sheet for water-decomposable absorbent articles. Even though having absorbed body discharge fluid, the fibrous sheet could still maintain a predetermined level of wet strength, and is therefore deformed little during use. When the fibrous sheet is combined with any other fibers, it is usable as an absorbent layer, a cushion layer, a back sheet, etc.

If desired, the fibrous sheet of the invention may be embossed. Concretely, it may be embossed under heat with a small amount of water being added thereto, whereby the hydrogen bonding of the fibrillated rayon fibers therein to each other and optionally to other fibers, if any other fibers are contained therein, is augmented, and the dry strength of the fibrous sheet is enhanced. If still desired, the water-decomposable fibrous sheet of the invention may have a multi-layered structure of which the top layer contains a larger amount of fibrillated rayon.

EXAMPLES

The invention is described in more detail with reference to the following Examples, which, however, are not intended to restrict the scope of the invention.

Example A

Rayon fibers (from Acordis Japan, having a fiber length of 3 mm and a fineness of 1.7 dtex) were fibrillated in a mixer to prepare a first type of fibrillated rayon having a degrees of beating of 100 cc. Similarly, rayon fibers (from Acordis Japan, having a fiber length of 5 mm and a fineness of 1.7 dtex) were fibrillated in a mixer to prepare a second type of fibrillated rayon having a degrees of beating of 377 cc.

Combined with bleached soft-wood kraft pulp (NBKP, Canadian Standard Freeness, CSF=600 cc), the first and second types of fibrillated rayon were sheeted in wet into a fibrous web by the use of a square sheeting machine. The resulting fibrous web was dried with a rotary drier to be a fibrous sheet. In this step, the blend ratio of the fibers was varied in each Example. The fiber length of the fibrillated rayon given in Table 3 is that of the non-beaten rayon. The water-decomposable fibrous sheets obtained herein were tested for decomposability in water and wet strength, according to the methods mentioned below.

The test for decomposability in water was based on the test of JIS P-4501 indicating the degree of degradability of toilet paper. Precisely, a piece of the water-decomposable fibrous sheet having a length of 10 cm and a width of 10 cm was put into a300-ml beaker filled with 300 ml of ion-exchanged water, and stirred therein with a rotor. The revolution speed of the rotor was 600 rpm. The condition of the test piece being dispersed in water was macroscopically observed at predetermined time intervals, and the time until the test piece was dispersed was measured (see the following Table—the data are expressed in seconds).

The wet strength was measured according to the test method stipulated in JIS P-8135. Briefly, a piece of the water-decomposable fibrous sheet having a width of 25 mm and a length of 150 mm was tested both in the machine direction (MD) and in the cross direction (CD), by the use of a Tensilon tester, for which the chuck distance was 100 mm and the stress rate was 100 mm/min. The strength at break of the test piece thus measured indicates the wet strength thereof (see the following Table—the data are expressed in N/25 mm). The mean value of the data shown in the Table is a root square of the data in MD and CD, √(MD×CD).

Fibrous sheets of Comparative Examples 1 and 2 were produced in the same manner as in Examples, for which was used either one of the two types of fibrillated rayon combined with the pulp.

TABLE 3

| | | Comp. Ex. 1 | Example 1 | Example 2 | Example 3 | Comp. Ex. 2 |
|---|---|---|---|---|---|---|
| NBKP (%) | | 20 | 20 | 20 | 20 | 20 |
| First type of fibrillated rayon (%) | 1.7 dtex × 3 mm | — | 20 | 40 | 60 | 80 |
| Second type of fibrillated rayon (%) | 1.7 dtex × 5 mm | 80 | 60 | 40 | 20 | — |
| Weight (g/m$^2$) | | 44.3 | 40.6 | 41.3 | 38.5 | 36.2 |
| Thickness (mm) | | 0.37 | 0.39 | 0.38 | 0.34 | 0.37 |
| Dry strength (N/25 mm) | MD | 18.36 | 15.51 | 16.77 | 13.82 | 12.56 |
| Dry strength (N/25 mm) | CD | 15.47 | 19.64 | 16.58 | 12.54 | 12.29 |
| Dry strength (N/25 mm) | ✓(MD × CD) | 16.85 | 17.45 | 16.67 | 13.16 | 12.44 |
| Wet strength (N/25 mm) | MD | 5.086 | 4.429 | 3.733 | 2.587 | 1.871 |
| Wet strength (N/25 mm) | CD | 4.557 | 5.184 | 3.508 | 2.606 | 1.969 |
| Wet strength (N/25 mm) | ✓(MD × CD) | 4.82 | 4.79 | 3.62 | 2.60 | 1.92 |
| Decomposability in water of dry sheet (sec) | | 145 | 120 | 77 | 77 | 67 |
| Decomposability in water of wet sheet (sec) | | 300 or more | 146 | 122 | 102 | 74 |

From Table 3, it is understood that the water-decomposable fibrous sheets containing two different types of fibrillated rayon have higher wet strength than those containing only one type of fibrillated rayon, and incorporating such two different types of fibrillated rayon in the fibrous sheets does not lower the decomposability of the sheets in water.

Example B

Fibers shown in Table 4 were sheeted by the use of a vat paper-making machine, and processed with water jets of 30 kg/cm$^2$ to produce fibrous sheets. The processing speed was 30 m/min. The resulting fibrous sheets were wetted with water in the same manner as in Example A. These were tested for dry strength, wet strength, dry elongation and wet elongation in MD and CD, and for decomposability in water. The elongation of each sample was measured according to JIS P-8132. Fibrous sheets of Comparative Examples were produced in the same manner as in Example B, for which was used either one of the two types of fibrillated rayon. These were tested in the same manner as herein. The data obtained are given in Table 4.

TABLE 4

| | | Co. Ex. 1 | Co. Ex. 2 | Example |
|---|---|---|---|---|
| Formulation | NBKP (free beaten) | 50% | 50% | 50% |
| | Rayon (1.1 dtex × 5 mm) | 40% | 40% | 40% |
| | Fibrillated rayon (1.7 dtex × 3 mm, Degree of beating 185 cc) | 10% | — | 5% |
| | Fibrillated rayon (1.7 dtex × 5 mm, Degree of beating 205 cc) | — | 10% | 5% |
| Weight | g/m$^2$ | 52.85 | 51.36 | 52.28 |
| Thickness | mm | 0.503 | 0.516 | 0.523 |
| Dry strength | N/25 mm | 4.69 | 6.61 | 6.73 |

TABLE 4-continued

| | | Co. Ex. 1 | Co. Ex. 2 | Example |
|---|---|---|---|---|
| MD | | 4.92 | 7.00 | 7.04 |
| (n = 5) | | 4.78 | 6.65 | 6.79 |
| | | 4.97 | 7.30 | 6.43 |
| | | 4.79 | 6.73 | 7.50 |
| | Ave. | 4.83 | 6.86 | 6.90 |
| | Standard deviation | 0.09 | 0.23 | 0.30 |
| Dry elongation MD | % | 4.67 | 5.56 | 5.86 |
| Dry strength | N/25 mm | 4.76 | 6.39 | 5.39 |
| CD | | 4.63 | 5.04 | 5.49 |
| (n = 5) | | 4.20 | 5.32 | 4.94 |
| | | 4.13 | 5.63 | 5.27 |
| | | 4.33 | 5.37 | 5.18 |
| | Ave. | 4.41 | 5.55 | 5.25 |
| | Standard deviation | 0.23 | 0.37 | 0.15 |
| Dry elongation CD | % | 9.977 | 5.56 | 3.27 |
| Wet strength | N/25 mm | 1.32 | 1.80 | 1.76 |
| MD | | 1.25 | 1.86 | 2.23 |
| (n = 5) | | 1.36 | 1.86 | 1.85 |
| | | 1.33 | 1.84 | 1.85 |
| | | 1.30 | 1.11 | 1.88 |
| | Ave. | 1.32 | 1.70 | 1.92 |
| | Standard deviation | 0.029 | 0.235 | 0.127 |
| Wet elongation MD | % | 20.74 | 23.8 | 24.21 |
| Wet strength | N/25 mm | 1.36 | 1.73 | 1.45 |
| CD | | 1.55 | 1.63 | 1.61 |
| (n = 5) | | 1.65 | 1.59 | 1.40 |
| | | 1.50 | 1.67 | 1.66 |
| | | 1.74 | 1.39 | 2.26 |
| | Ave. | 1.56 | 1.60 | 1.68 |
| | Standard deviation | 0.108 | 0.089 | 0.235 |

TABLE 4-continued

| | Co. Ex. 1 | Co. Ex. 2 | Example |
|---|---|---|---|
| Wet elongation CD % | 31.71 | 27.41 | 29.46 |
| Decomposability in water (dry sheets), seconds | 28 | 45 | 41 |
| Decomposability in water (wet sheets), seconds | 46 | 58 | 48 |

From Table 4, it is understood that the fibrous sheet of Example has better decomposability in water and higher strength than the fibrous sheets of Comparative Examples that contain only one type of fibrillated rayon.

As is understood from the test data as above, the water-decomposable fibrous sheet of the invention has good decomposability in water and high strength, taking advantage of the tangling and/or hydrogen-bonding force of the microfibers that extend from the fibrillated rayon therein. In particular, the fibrous sheet of the invention contains first and second types of fibrillated rayon each having a different fiber length, and therefore has high strength. The combined types of fibrillated rayon in the fibrous sheet do not detract from the decomposability in water of the sheet.

Here, 'comprises/comprising' when used in this specification is taken to specify the presence of stated features, integers, steps or components but does not preclude the presence or addition of one or more other features, integers, steps, components or groups thereof.

While the invention has been described in detail and with reference to specific embodiments thereof, it will be apparent to one skilled in the art that various changes and modifications can be made therein without departing from the spirit and scope thereof.

What is claimed is:

1. A water decomposable fibrous sheet comprising fibers containing fibrillated rayon, the fibrillated rayon having primary fibers of a predetermined fiber length and microfibers extending from the primary fibers;

the fibrillated rayon including a first fibrillated rayon having a degree of beating of at most 700 cc, of which the length of the primary fibers falls between 1.8 mm and 4.0 mm at the peak of its self weighted, average fiber length distribution profile curve, and a second fibrillated rayon having a degree of beating of at most 700 cc, of which the length of the primary fibers falls between 4.5 mm and 10.0 mm at the peak of its self weighted, average fiber length distribution profile curve, and the microfibers extending from the first fibrillated rayon and the second fibrillated rayon being entangled with and/or hydrogen bonded to at least either of other microfibers and other fibers.

2. The water decomposable fibrous sheet as claimed in claim 1, wherein the microfibers having a length of at most 1 mm in the first fibrillated rayon and the second fibrillated rayon account for from 0.1 to 65% by mass of the self weight of the fibrillated rayon.

3. The water decomposable fibrous sheet as claimed in claim 1, which contains each of the first fibrillated rayon and the second fibrillated rayon in an amount of at least 3% by mass of all the fibers constituting the fibrous sheet.

4. The water-decomposable fibrous sheet as claimed in claim 1, which contains at least 5% by mass of other fibers having a length of at most 10 mm, in addition to the fibrillated rayon.

5. The water-decomposable fibrous sheet as claimed in claim 1, which is a non-woven fabric having been subjected to water-jetting treatment.

6. The water-decomposable fibrous sheet as claimed in claim 1, which is produced in a paper-making process.

7. The water-decomposable fibrous sheet as claimed in claim 1, wherein the degree of fineness of the fibrillated rayon falls between 1.1 and 1.9 dtex.

8. The water-decomposable fibrous sheet as claimed in claim 1, wherein the weight of the fibers falls between 20 and 100 g/m$^2$.

9. The water decomposable fibrous sheet as claimed in claim 1, of which the decomposability in water is at most 200 seconds.

10. The water-decomposable fibrous sheet as claimed in claim 1, of which the wet strength is at least 1.1 N/25 mm.

11. The water-decomposable fibrous sheet as claimed in claim 1, of which the dry strength is at least 3.4 N/25 mm.

12. The water decomposable fibrous sheet as claimed in claim 9, wherein the decomposability of the sheet in water is measured in accordance with JIS P 4501.

* * * * *